United States Patent [19]

Thom et al.

[11] Patent Number: 4,820,173

[45] Date of Patent: Apr. 11, 1989

[54] PLUG CONNECTOR STRIP COMPRISING CONTACT SPRINGS ARRANGED IN AT LEAST TWO PARALLEL ROWS

[75] Inventors: Guenter Thom, Gauting; Georg Neuber, Munich, both of Fed. Rep. of Germany

[73] Assignee: Siemens Aktiengesellschaft, Berlin and Munich, Fed. Rep. of Germany

[21] Appl. No.: 188,692

[22] Filed: May 2, 1988

Related U.S. Application Data

[63] Continuation of Ser. No. 7,518, Jan. 28, 1987, abandoned.

[30] Foreign Application Priority Data

Feb. 27, 1986 [DE] Fed. Rep. of Germany ..... 3606387

[51] Int. Cl.[4] ..... H01R 23/70

[52] U.S. Cl. ..... 439/79

[58] Field of Search ..... 439/79, 80, 83

[56] References Cited

U.S. PATENT DOCUMENTS

| | | | |
|---|---|---|---|
| 4,418,972 | 12/1983 | Benasutti | 339/207 R |
| 4,505,035 | 3/1985 | Burton et al. | 29/840 |
| 4,530,553 | 7/1985 | Aujla | 439/260 |
| 4,660,911 | 4/1987 | Reynolds | 339/17 LC |
| 4,676,565 | 6/1987 | Reichardt | 439/79 |
| 4,695,106 | 9/1987 | Feldman et al. | 439/83 |

*Primary Examiner*—Neil Abrams

*Attorney, Agent, or Firm*—Hill, Van Santen, Steadman & Simpson

[57] ABSTRACT

In a plug connector strip comprising contact springs, the contact springs include terminal lugs which press against a printed circuit board connected to the plug connector strip. For the compensation of tolerances in the thickness of the printed circuit boards, the terminal lugs are fixed only in a clamping point arranged within the plug connector strip and are therefore resiliently seated. The terminal lugs can be bent roughly at a right angle immediately after they emerge from the plug connector strip and can be constructed in a straight-line manner so that they press roughly perpendicularly against corresponding contact pads of the printed circuit board and are therefore particularly suited for a reflow of solder connection.

4 Claims, 2 Drawing Sheets

PLUG CONNECTOR STRIP COMPRISING CONTACT SPRINGS ARRANGED IN AT LEAST TWO PARALLEL ROWS

This is a continuation, of application Serial No. 007,518, filed Jan. 28, 1987 and now abandoned.

BACKGROUND OF THE INVENTION

1. Field of the Invention

The present invention relates to a plug connector strip comprising contact springs arranged in at least two parallel rows for electrical connection to a printed circuit board mechanically connected to the plug connector strip and arranged between rows of contact springs, the printed circuit board comprising contact pads of electrically conductive material on both the sides thereof against which press contact spring terminal lugs corresponding thereto and emerging at the side of the plug connector strip facing toward the printed circuit board.

2. Description of the Prior Art

Plug connector strips comprising contact springs arranged in at least two parallel rows are already known in the art for the electrical connection of contacts to a printed circuit board which is mechanically connected to the plug connector strip. In the known plug connector strips, contact spring terminal lugs emerge obliquely from the plug connector strip, for example, at an angle of 45°, and extend to corresponding contact pads on the printed circuit board. Relatively long dimensions for the terminal lugs thereby occur, these potentially leading to undesired cross-talk and potentially reducing the quality of transmission.

Plug connector strips are likewise already known in the art in which terminal lugs of contact springs arranged in a plurality of parallel rows press against both sides of an inserted printed circuit board. In these known plug connector strips, the contact springs are rigidly seated in the plug connector strip. The terminal lugs extend obliquely from the plug connector strip to the printed circuit board and comprise angular extensions that press against both surfaces of the printed circuit boards. Relatively long, undesired dimensions likewise occur for the terminal lugs given these arrangements. Moreover, the contacting pressure of the terminal lugs which press obliquely against the surfaces of the printed circuit boards cannot always reach values that are required for soldering the terminal lugs onto the printed circuit board.

SUMMARY OF THE INVENTION

The object of the present invention is to provide a plug connector strip of the type set forth above such that a reliable electrical connection with, for example, the assistance of what is referred to as the reflow soldering process is guaranteed, even given tolerances of the printed circuit board thickness.

For a plug connector strip of the aforementioned type, this object is achieved, according to the present invention, in that the contact spring terminal lugs are fixed in a clamping point arranged within the plug connector strip.

The present invention provides the advantage that, given utilization of printed circuit boards having different board thicknesses, the contacting pressure required for the electrical connection, for example, by reflow soldering, is always established. The invention also provides the further advantage that the contacting of the terminal lugs uses little space on the printed circuit board.

The terminal lugs comprise relatively short dimensions, so that the plug connector strip constructed in accordance with the present invention is distinguished by favorable values for cross-talk and quality of transmission.

BRIEF DESCRIPTION OF THE DRAWINGS

Other objects, features and advantages of the invention, its organization, construction and operation will be best understood from the following description, taken in conjunction with the accompanying drawings, on which.

DESCRIPTION OF THE PREFERRED EMBODIMENT

Figure 1:
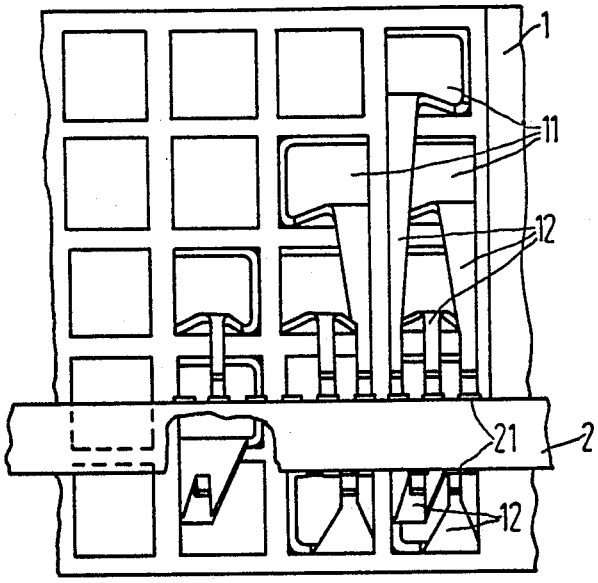
FIG. 1 is an elevation view of the side of a plug connector strip facing toward a printed circuit board and comprising the contact spring terminal lug.

FIG. 1 illustrates a plug connector strip 1 and a printed circuit board 2 connected thereto. The plug connector strip 1 compprises a plurality of parallel rows having contact spring chambers 11 of which some chambers contain contact springs which are fashioned into terminal lugs 12 at the side of the plug connector strip 1 illustrated in FIG. 1.

The printed circuit board 2 is inserted between the terminal lugs of different rows of contact springs. The printed circuit board 2 can be arranged in the center plane of the plug connector strip or, as shown in FIG. 1, can be asymmetrically arranged.

As shall be set forth in greater detail below with respect to FIG. 2, the contact springs or, respectively, the terminal lugs 12 arranged in the chambers 11 are not seated rigid throughout in the chambers 11, but are fixed only in a clamping point 13 arranged in the chambers 11, i.e., within the plug connector strip. A resilient bearing thereby occurs for the terminal lugs 12 from the clamping point 13 arranged within the chambers 11 up to the free ends of the terminal lugs 12.

Immediately after they emerge from the plug connector strip 1, the contact terminal lugs 12 are bent about a right angle and extend roughly parallel to that side of the plug connector strip facing toward the printed circuit board. The contact terminal lugs 12 are formed generally straight facing towards the printed circuit board and the corresponding contact pads 21 of the printed circuit board 2. The contact spring terminal lugs 12 therefore press roughly perpendicularly against the corresponding contact pads 21 of the printed circuit board 2. As illustrated in FIG. 1, the terminal lugs 12 are cut such that the terminal lugs of all contact springs arranged at respectively one side of the printed circuit board 2 resiliently press against the corresponding contact pads 21 of the printed circuit board 2 immediately adjacent one another. These terminal lugs 12 lie in a common plane parallel to that side of the plug connector strip 1 facing towards the printed circuit board 2.

This arrangement is distinguished by short dimensions and by adequately high values for the contacting pressure effected by the perpendicular incident terminal lugs 12, this enabling a reliable contacting of the terminal lugs 12 to the corresponding contact pads 21, particularly in accordance with what is referred to as the reflow soldering process.

Figure 2:
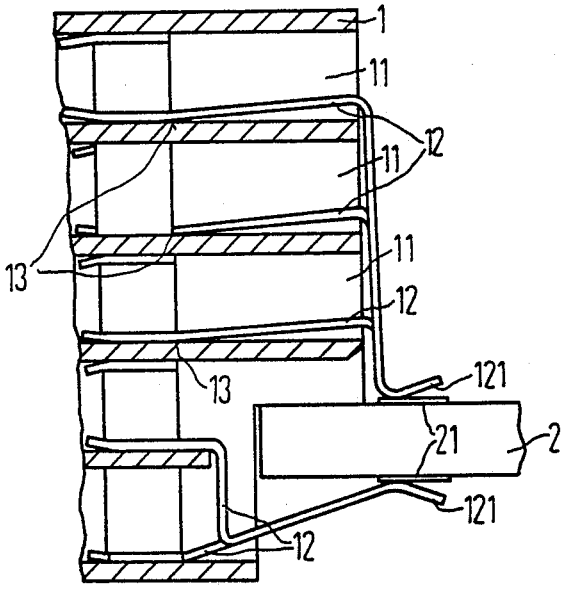
FIG. 2 is a fragmentary cross-sectional view through the arrangement illustrated in FIG. 1.

FIG. 2 illustrates both the bearing of the contact springs or, respectively, of the terminal lugs 12 in the chambers 11, as well as the pressing of the terminal lugs 12 against the contact pads 21 of the printed circuit board 2. As already mentioned above, the terminal lugs 12 and the contact pads 21 are connected to one another in a conductive manner, for example, in accordance with what is referred to as the reflow soldering process. When another printed circuit board 2 having a greater board thickness is inserted between the contact spring terminal 12, instead of the printed circuit board 2 illustrated in FIG. 2, then the terminal lugs 12 resiliently seated within the chambers 11, move in the direction of the chambers 11 by a corresponding distance. At the same time, the pressure exerted on the printed circuit board 2 by the terminal lugs 12 is increased.

The contact spring terminal lugs 12 comprise extensions 121 that are bent relative to the portions arranged between the plug connector strip 1 and the contact locations 12. These extensions can press against the corresponding surface of the printed circuit board 2 or, respectively, can be bent by a maximum of 90° relative to this surface of the printed circuit board 2. The extensions 121 of all of the contact spring terminal lugs 12 emerging from a row of contact springs are bent at the same angle relative to the adjacent surface of the printed circuit board 2. Angles between 30° and 45° have proven particularly advantageous.

Figure 3:
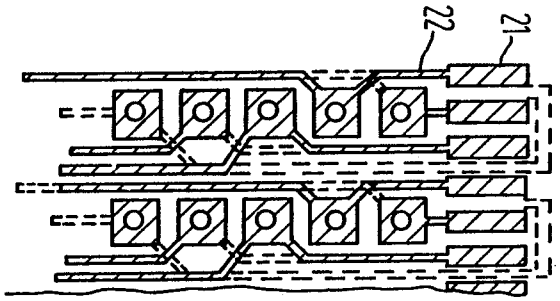
FIG. 3 is a sectional view of a portion of a printed circuit board which is connectable to the plug connector strip.

FIG. 3 illustrates a portion of the printed circuit board 2 comprising contact pads 21, whereby, as illustrated in FIG. 1, three rows of contact springs having terminal lugs 12 bear there against, for example, against the one side of the printed circuit board and, for example, two rows of contact springs having terminal lugs 12 bear against the other side of the printed circuit board 2 and are connected to one another in accordance with, for example, what is referred to as the reflow soldering process, being connected to one another in a conductive manner. As already illustrated in FIGS. 1 and 2, therefore, the contact pads are arranged at both sides of the printed circuit board 2 and augment one another to form interconnects 22. As shown in FIG. 3 the contact pads 21 have an elongate, rectangular shape which, however, can advantageously be relatively small in area and, therefore, comprise space saving structures.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a plug connector strip which comprises contact springs arranged in respective chambers of a housing in at least two parallel rows for electrical and physical connection to contact pads on both sides of a printed circuitboard, the housing including an exterior surface and the chambers opening to the exterior through the exterior surface, the improvement wherein:

each of said contact springs is resilient and is mounted at a respective clamping point within the respective chamber spaced inwardly from the exterior surface and extends out of the respective chamber;

the contact springs of at least one row each include a straight section extending at a right angle immediately after emergence from the respective housing chamber;

each of said contact springs of said at least one row includes a distal end section having a contact portion for pressing substantially perpendicularly against the respective contact pad; and said distal section comprises a bent section defining an arc as said contact portion for engagement with the respective contact pad, wherein a portion of said contact springs of one row, when pressed against said contact pads, become elevated over a floor of their respective chambers due to the force of the contact pads on said distal end section.

2. The improved plug connector strip of claim 1, wherein:

said distal sections of all contact springs of a row of contact springs are bent at the same angle relative to the adjacent surface of the printed circuitboard.

3. The improved connector strip of claim 2, wherein:

each of said distal ends of said contact strips are bent at a maximum 90° relative to the adjacent surface of the printed circuitboard.

4. The improved plug connector strip of claim 3, wherein:

each of said distal ends is bent at an angle of between 30° and 45° relative to the adjacent surface of the printed circuitboard.

* * * * *